US009398667B2

(12) United States Patent
Kevelos et al.

(10) Patent No.: US 9,398,667 B2
(45) Date of Patent: Jul. 19, 2016

(54) DIMMER SWITCH HAVING DIMMER ACTUATOR OPERABLE FOR ACTUATING AN AIR-GAP SWITCH

(71) Applicant: Leviton Manufacturing Co., Inc., Melville, NY (US)

(72) Inventors: Adam Kevelos, Plainview, NY (US); Ronald Jansen, Ridgewood, NY (US); Renjith Mathew, New Hyde Park, NY (US); Michael Kamor, North Massapequa, NY (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 152 days.

(21) Appl. No.: 14/455,616

(22) Filed: Aug. 8, 2014

(65) Prior Publication Data

US 2016/0044764 A1 Feb. 11, 2016

(51) Int. Cl.
*H05B 37/02* (2006.01)

(52) U.S. Cl.
CPC ..... *H05B 37/02* (2013.01)

(58) Field of Classification Search
CPC ..... H05B 37/02
USPC ..... 315/326; 200/315, 553, 339; 174/53, 57
See application file for complete search history.

(56) References Cited

U.S. PATENT DOCUMENTS

| | | | |
|---|---|---|---|
| 5,012,495 | A | 4/1991 | Munroe et al. |
| 5,262,678 | A | 11/1993 | Flowers et al. |
| 5,945,647 | A | 8/1999 | Hoskins |
| 6,005,308 | A | 12/1999 | Bryde et al. |
| 7,170,018 | B2 | 1/2007 | Ilkhanov |
| 7,345,998 | B2 | 3/2008 | Cregg et al. |
| 7,663,325 | B2 | 2/2010 | McDonough et al. |
| 7,670,039 | B2 | 3/2010 | Altonen et al. |
| 7,985,937 | B2 | 7/2011 | Wu et al. |
| 8,003,904 | B2 | 8/2011 | Wu |
| 8,138,435 | B2 | 3/2012 | Patel et al. |
| 8,173,920 | B2 | 5/2012 | Altonen et al. |
| 8,459,812 | B2 | 6/2013 | Wu et al. |
| 8,536,473 | B2 | 9/2013 | Goyal et al. |
| 8,669,720 | B2 | 3/2014 | Goyal et al. |
| 8,717,718 | B2 | 5/2014 | Kamor et al. |
| 2007/0193863 | A1 | 8/2007 | Wu |

(Continued)

OTHER PUBLICATIONS

Adam Kevelos, pending U.S. Appl. No. 14/455,610, filed Aug. 8, 2014, "Electrical Dimmer Having Dimming Level Indicator Assembly".

(Continued)

*Primary Examiner* — Daniel D Chang
(74) *Attorney, Agent, or Firm* — Heslin Rothenberg Farley and Mesiti PC

(57) ABSTRACT

A dimmer switch includes an air-gap switch for coupling to a power source, a power semiconductor switch electronically controlling power to a load connected in series with the air-gap switch, a dimmer module connected to the power semiconductor switch for coupling to the load to deliver an adjustable level of power to the load, and a dimmer actuator. The dimmer actuator is movable between an operational position and a disconnected position wherein the dimmer actuator is configured to act as a single control mechanism for selectively engaging either the dimmer module to adjust the level of power delivered to the load when in the operational position or the air-gap switch when in the disconnected position.

23 Claims, 9 Drawing Sheets

(56) References Cited

U.S. PATENT DOCUMENTS

| | | | | |
|---|---|---|---|---|
| 2010/0101924 | A1 | 4/2010 | Wu et al. | |
| 2010/0214756 | A1 | 8/2010 | Feldstein | |
| 2012/0257316 | A1 | 10/2012 | Kamor et al. | |
| 2013/0162167 | A1 * | 6/2013 | Gallo ..... | H05B 33/0815 315/287 |
| 2013/0162168 | A1 | 6/2013 | Ostrovsky | |

OTHER PUBLICATIONS

Product Brochure for the Mural Collection, Leviton Manufacturing Co., Inc., Melville, New York, 12 pages, 2000.

Product Brochure for The Mural Collection II, Leviton Manufacturing Co., Inc., Melville, New York, 7 pages, 2002.

* cited by examiner

DIMMER SWITCH HAVING DIMMER ACTUATOR OPERABLE FOR ACTUATING AN AIR-GAP SWITCH

FIELD OF THE DISCLOSURE

The present disclosure relates generally to dimmer switches, and more particularly, to dimmer switches including an air gap switch.

FIELD OF THE DISCLOSURE

The present disclosure relates generally to dimmer switches, and more particularly, to dimmer switches including an air gap switch.

BACKGROUND

Electrical wiring systems often include one or more electrical wiring devices, such as dimmer switches, that control power to one or more loads. A dimmer switch has a main actuator for turning power ON/OFF to the load. An example of such an actuator includes a paddle or push pad capable of being depressed within a frame located on the front face of the dimmer. The dimmer switch also includes a dimmer actuator for controlling the amount of power to the load. In addition, agencies, such as Underwriters Laboratories (UL) and Canadian Standards Association (CSA), require certain electrical load control devices, including certain dimmer switches, to have an air-gap switch. An air-gap switch provides a mechanical means of disconnecting power to the dimmer.

U.S. Pat. No. 8,003,904, issued to Wu, discloses a dimmer switch having a first switch for coupling to a power source, a second switch, a dimmer module, and a main actuator movable between an operational position and a disconnected position. The main actuator includes a first switch actuator and a second switch actuator. The first switch may be a normally-closed air-gap switch including a lever in contact with the first switch actuator. Movement of the main actuator between the operational position and the disconnected position is effective to open the switch. The main actuator is pivotally coupled to a frame. A coupling between the main actuator and the frame includes a pivot in a pivot holder. A partial cylindrical surface of the pivot is in contact with a surface of the pivot holder which includes a first portion having a partial cylindrical surface and a second portion having a ramp surface.

U.S. Pat. No. 7,985,937, issued to Wu et al., discloses a switching device having a paddle actuator biased to a rest position and configured to pivot relative to a housing to a depressed position to engage an air-gap switch disposed within the housing. The air-gap switch is configured to change a first state of a load connected to the switching device when engaged by the paddle actuator. The paddle actuator is defined by a pair of opposing long sides and a pair of opposing short sides and has at least one slot defined therein parallel to the pair of opposing short sides thereof and centrally disposed between the pair of opposing long sides thereof. A rocker actuator is disposed in the at least one slot defined in the paddle actuator and is configured to pivot relative thereto to engage at least one switch. The at least one switch is configured to change a second state of the load connected to the switching device upon engagement by the rocker actuator.

There is a need for further dimmer switches, and more particularly, for dimmer switches having an air gap switch.

SUMMARY

In a first aspect, the present disclosure provides a dimmer switch comprising an air-gap switch for coupling to a power source, a power semiconductor switch connected in series with the air-gap switch, the power semiconductor switch electronically controlling power to a load, a dimmer module, connected to the power semiconductor switch, for coupling to the load to deliver an adjustable level of power to the load, and a dimmer actuator movable between an operational position and a disconnected position wherein the dimmer actuator is configured to act as a single control mechanism for selectively engaging either the dimmer module to adjust the level of power delivered to the load when in the operational position or the air-gap switch when in the disconnected position.

In a second aspect, the present disclosure provides a dimmer switch comprising an air-gap switch for coupling to a power source, a power semiconductor switch connected in series with the air-gap switch, the power semiconductor switch electronically controlling power to a load, a dimmer module, connected to the power semiconductor switch, for coupling to the load to deliver an adjustable level of power to the load, and a dimmer actuator movable between an operational position and a disconnected position wherein the dimmer actuator is configured to act as a single control mechanism for selectively engaging either the dimmer module to adjust the level of power delivered to the load when in the operational position or the air-gap switch when in the disconnected position. The dimmer actuator comprises an elongated member having a first elongated side comprising a first outwardly extending post having a first axis, and an opposite second elongated side comprising a second outwardly extending post having a second axis offset from the first outwardly extending post, and the dimmer actuator being generally pivotable about the first post when in the operational position, and generally pivotable about the second post when in the disconnected position.

In a third aspect, the present disclosure provides a dimmer switch comprising an air-gap switch for coupling to a power source, a power semiconductor switch connected in series with the air-gap switch, the power semiconductor switch electronically controlling power to a load, a dimmer module, connected to the power semiconductor switch, for coupling to the load to deliver an adjustable level of power to the load, a dimmer actuator movable between an operational position and a disconnected position wherein the dimmer actuator is configured to act as a single control mechanism for selectively engaging either the dimmer module to adjust the level of power delivered to the load when in the operational position or the air-gap switch when in the disconnected position, and a frame having a central opening for accommodating a main actuator operable for engaging the power semiconductor switch, and a second opening for receiving the dimmer actuator, the dimmer actuator being connected about a first pivot axis relative to the frame when in the operational position, and connected about a second pivot axis relative to the frame different from the first pivot axis when in the disconnected position.

Additional features and advantages are realized through the concepts of the present disclosure. Other embodiments and aspects of the disclosure are described in detail herein and are considered a part of the claims.

BRIEF DESCRIPTION OF THE DRAWINGS

Various aspects of the present disclosure are particularly pointed out and distinctly claimed as examples in the claims at the conclusion of the specification. The foregoing and other objects, features, and advantages of the disclosure are apparent from the following detailed description taken in conjunction with the accompanying drawings in which:

DETAILED DESCRIPTION

Figure 1:
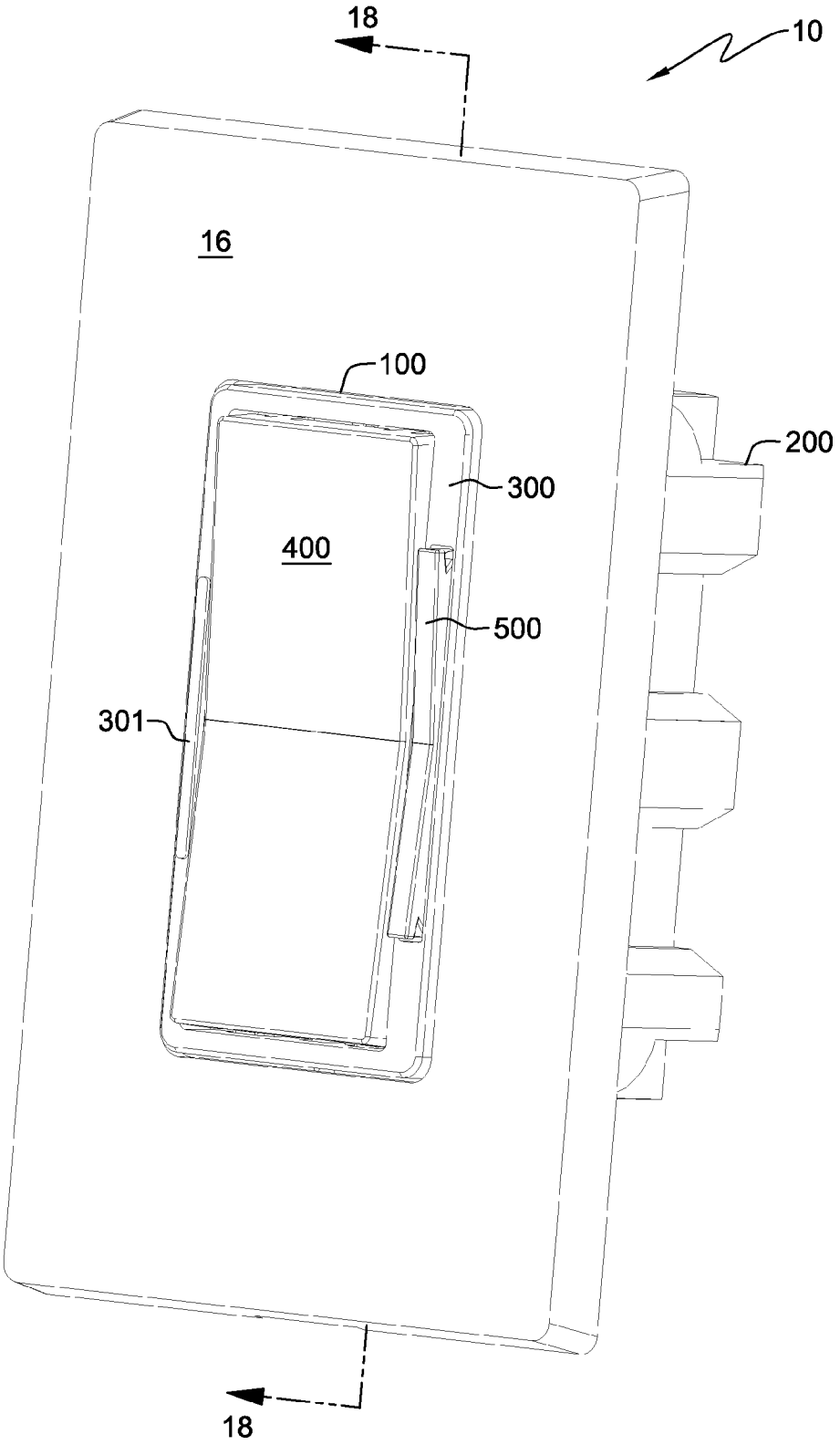
FIG. 1 is a perspective view of one exemplary embodiment of a dimmer switch and a wall plate in accordance with aspects of the present disclosure.

FIG. 1 illustrates one exemplary embodiment of a dimmer switch 10 in accordance with aspects of the present disclosure. In this exemplary embodiment, dimmer switch 10 may generally include a switch plate assembly 100 coupled to a dimmer module 200. Switch plate assembly 100 may be a self-contained unit which includes a frame 300, a rocker or main actuator 400, and a dimmer actuator 500. Switch plate assembly 100 may also include an intensity indicator region 301 to indicate the level of power being delivered to a load. Generally, a user may operate dimmer switch 10 by pressing main actuator 400 to operably switch power ON or OFF to a load, such as but not limited to a light fixture or to a fan. In addition, a user may operate dimmer actuator 500 to adjust the level of power to the load. As explained in greater detail below, dimmer actuator 500 may also be operable to actuate an air-gap switch (not shown in FIG. 1) for physically disconnecting power to the load. Frame 300 may include an opening for dimmer actuator 500 and an area operable for intensity indicator 301; e.g., a flat or raised portion including one or both of a plurality of visible and invisible indicator regions (raised portion with invisible indicator regions shown).

Figure 2:
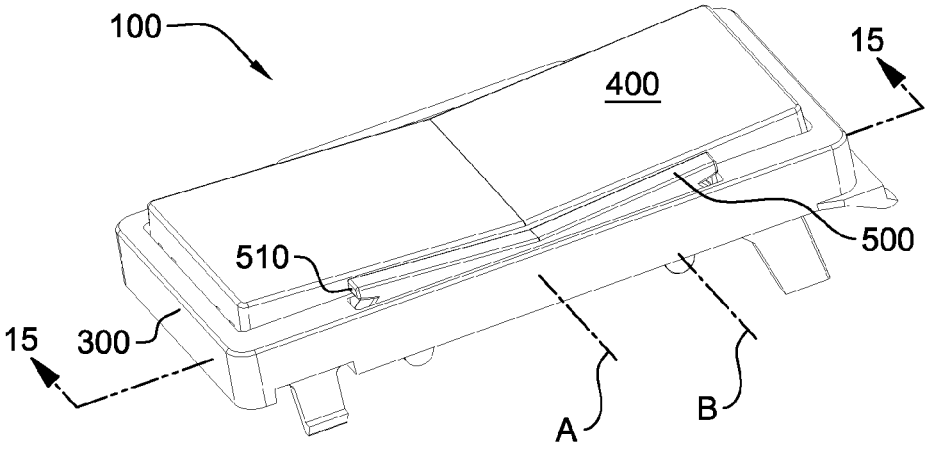
FIG. 2 is a perspective view of the switch plate assembly of the dimmer switch of FIG. 1 illustrating the dimmer actuator disposed in an unbiased position.
Figure 3:
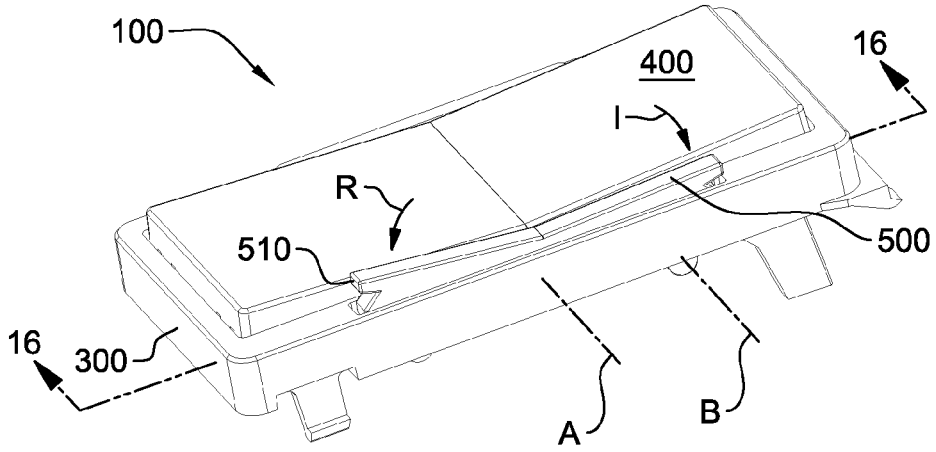
FIG. 3 is a perspective view of the switch plate assembly of the dimmer switch of FIG. 1 illustrating the dimmer actuator disposed in one possible operable position to adjust the level of power to the load.
Figure 4:
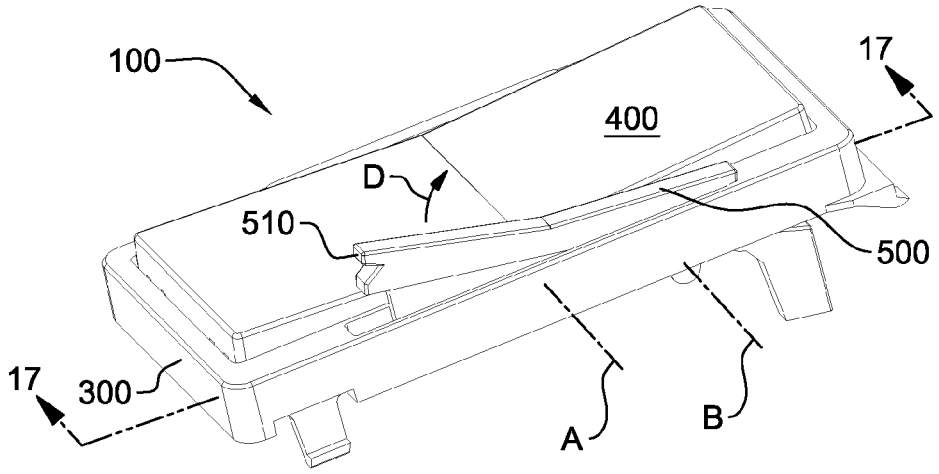
FIG. 4 is a perspective view of the switch plate assembly of the dimmer switch of FIG. 1 illustrating the dimmer actuator disposed in a disconnected position to effect an air gap switch.

FIGS. 2-4 illustrate switch plate assembly 100 with dimmer actuator 500 in various operable positions or orientations in connection with aspects of the present disclosure. For example, FIG. 2 generally illustrates dimmer actuator 500 disposed in an unbiased position or orientation, FIG. 3 illustrates dimmer actuator 500 disposed in a position or orientation operable to adjust the level of power to the load, and FIG. 4 illustrates dimmer actuator 500 disposed in a position or orientation to effect the air gap switch.

As explained in further detail below, dimmer actuator 500 may be pivotably coupled to frame 300 about a first pivot point or axis A and about a second pivot point or axis B, wherein the second pivot point or axis is different from the first pivot point or pivot axis. Dimmer actuator 500 may be disposed in an unbiased operational position (as shown in FIGS. 1 and 2), in which it is movably or pivotably coupled about a first axis to frame 300 so that dimmer actuator 500 is sufficiently disengaged from an air-gap switch to leave the air-gap switch in its ON (normally closed) position. With the air-gap switch in its ON position, dimmer switch 10 is electrically enabled, allowing a user to operate dimmer switch 10 by pressing main actuator 400 to switch power ON or OFF to a load, and to adjust the level of power to the load via operation of dimmer actuator 500. For example, as shown in FIG. 3, a user may press the top portion of dimmer actuator 500 in the direction of arrow I to increase the level of power to the load. Similarly, a user may press the bottom portion of dimmer actuator 500 in the direction of arrow R to reduce the level of power or dim the load.

As explained in further detail below, to disconnect power from dimmer switch 10, a user can move dimmer actuator 500 to its disconnected position, as shown in FIG. 4, by lifting or pivoting the bottom portion of dimmer actuator 500 such as by lifting lip 510 of dimmer actuator 500 from frame 300 in the direction of arrow D about second pivot axis B, to cause dimmer actuator 500 to engage the air-gap switch and place it in a disconnected position. When the air-gap switch is in the disconnected position, electrical power is physically disconnected from the load attached to the dimmer switch 10. Dimmer actuator 500 remains in its disconnected position until a user moves/pushes the bottom portion of dimmer actuator 500 downward, to its operational position, as shown in FIG. 2. As described below, the primary or first axis or pivot point may become a physical stop/rest point so that the dimmer actuator may not be pushed further back into the frame. The air-gap switch may be located behind dimmer actuator 500, and thus not visible from the front of dimmer switch 10. This may be advantageous since it does not adversely affect the appearance of the dimmer switch.

With reference again to FIG. 1, the front face of switch plate assembly 100 may extend through an opening of a wall plate 16, thereby providing access to the features of switch plate assembly 100, including main actuator 400 and dimmer actuator 500. Main actuator 400 may have any suitable shape, contour, dimensions, angles, etc. for functional and/or aesthetic reasons. The switch plate assembly may be configured to allow a user to easily replace an existing assembly with a new assembly, for example, in case the existing assembly is damaged. In another example, the switch plate assembly may be part of an interchangeable color change kit that enables an installer or end user to easily change the color of the visible portions of the device to coordinate with changes in the building décor or occupant preferences. Thus, a switch plate assembly may be replaced without having to remove dimmer module 200/switch 10. Dimmer switch 10, including dimmer module 200, switch plate assembly 100, and wall plate 16, may be made of a non-conductive material, such as but not limited to, plastic or other well known types of electrically non-conductive material. Alternatively, the user accessible surfaces of the dimmer, once installed, need not be non-conductive as long as the user accessible surfaces are electrically isolated from the building electrical system.

Figure 6:
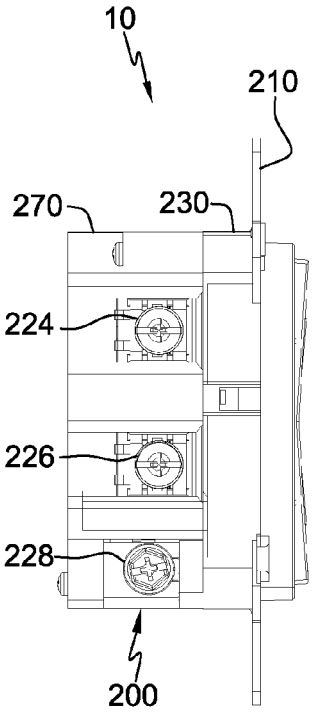
FIG. 6 is a left side view of the dimmer switch of FIG. 5.
Figure 5:
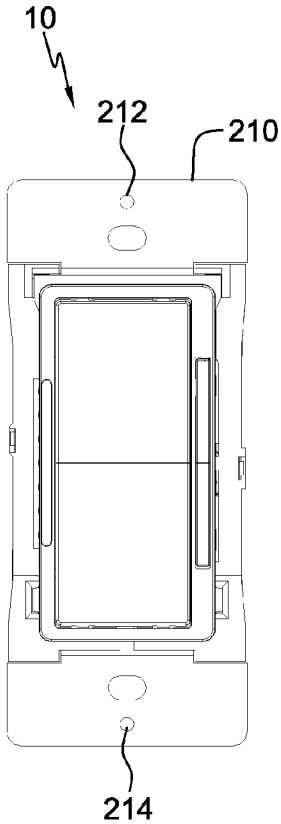
FIG. 5 is a front view of the dimmer switch of FIG. 1.
Figure 7:
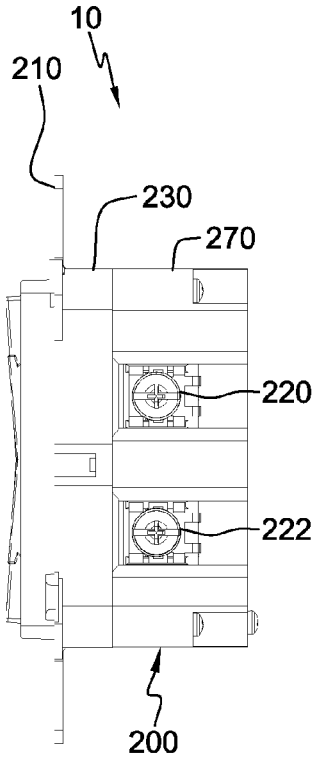
FIG. 7 is a right side view of the dimmer switch of FIG. 5.

With reference to FIGS. 5-7, dimmer switch 10 may include a mounting plate 210 that may be positioned generally between switch plate assembly 100 and dimmer module 200. In this exemplary embodiment, mounting plate 210 may include openings 212 and 214 to mount dimmer switch 10 to an electrical junction box (not shown). Mounting plate 210 may be sized to be mounted to an electrical junction box and be covered by a wall plate. Dimmer module 200 may include electrical wiring assembly terminals 220, 222, 224, 226, and 228 (i.e. line terminal, neutral terminal, load terminal, ground terminal) to secure electrical conductors to the wiring device. Alternatively, dimmer module 200 may include electrical wiring leads (not shown) to secure the premises electrical wiring conductors to the wiring device. Mounting plate 210 can be made of a non-conductive or conductive material and in the case of a conductive material, e.g., aluminum, may include a ground terminal (not shown) for connection to a ground conductor of an electrical wiring system.

Figure 8:
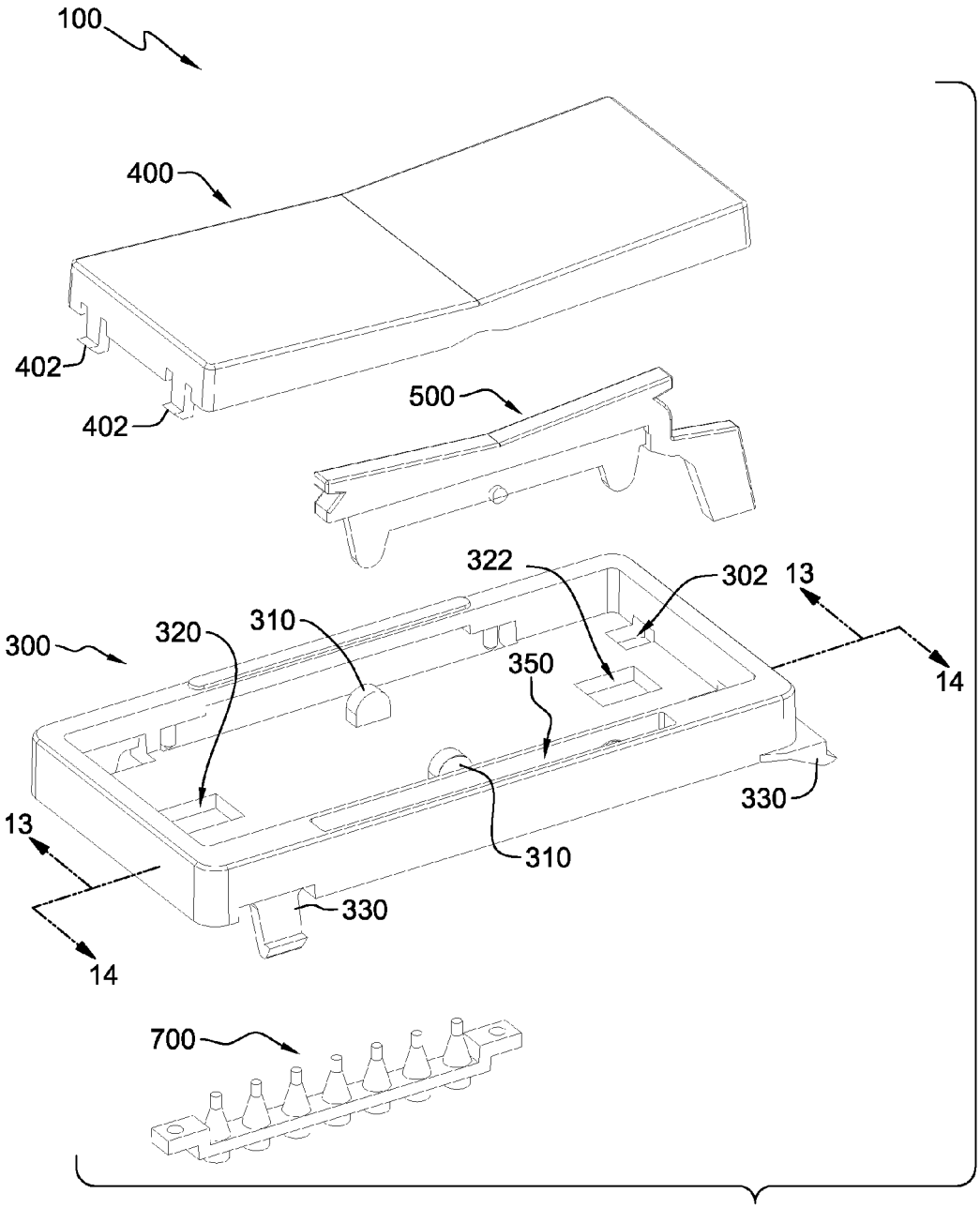
FIG. 8 is an exploded view of the switch plate assembly of the dimmer switch of FIG. 1.
Figure 9:
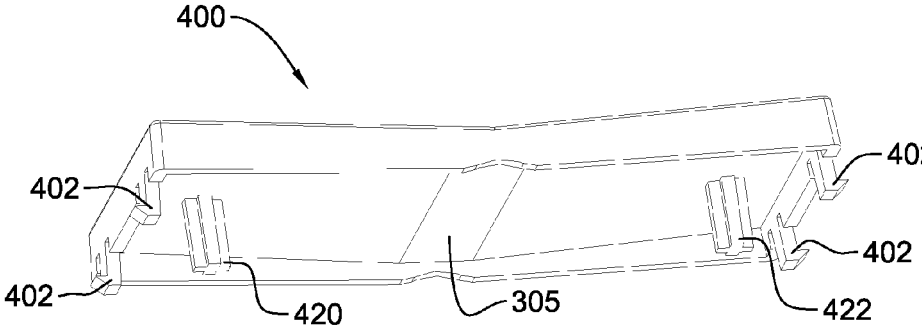
FIG. 9 is a bottom perspective view of the main actuator of FIG. 8.

As shown in FIGS. 8 and 9, frame 300 and main actuator 400 may be configured to be detachably coupled to each other. For example, tabs 402 on main actuator 400 may be detachably coupled to slots 302 (one of which is shown in FIG. 8) located in frame 300. A central bottom surface 305 of main actuator 400 may pivot and/or rock back and forth on pivots 310 of frame 300. Tabs 420 and 422 of main actuator 400 are arranged and configured to extend through openings 320 and 322 of frame 300 (FIG. 8) for turning the dimmer switch ON and OFF. Dimmer actuator 500 is coupled to frame 300 as disclosed in greater detail below. A light guide 700 may be operable for guiding light through intensity indicator region 301. It will be appreciated that the dimmer switch may or may not include an intensity indicator region and/or a light guide.

As shown in FIGS. 5-8, switch plate assembly 100 may be configured to be detachably coupled to an upper housing portion 230 of dimmer module 200. More specifically, tabs 330 of frame 300 may be detachably coupled to slots (not shown) located in housing portion 230.

Figure 10:
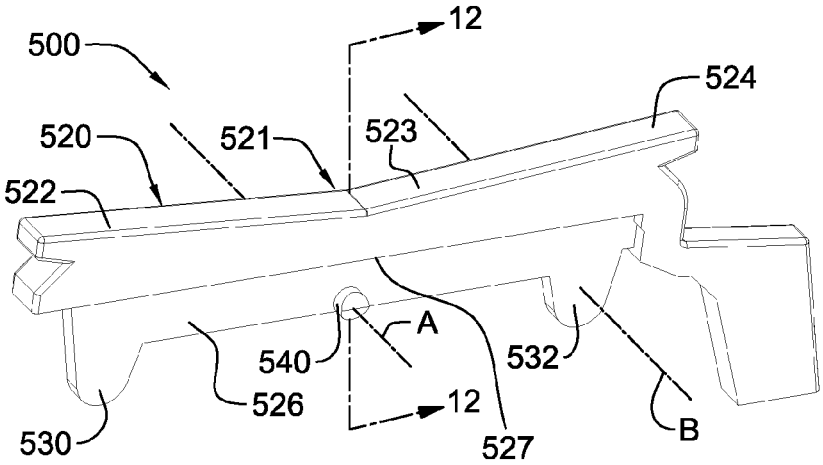
FIG. 10 is a first enlarged perspective view of the dimmer actuator of FIG. 1.
Figure 11:
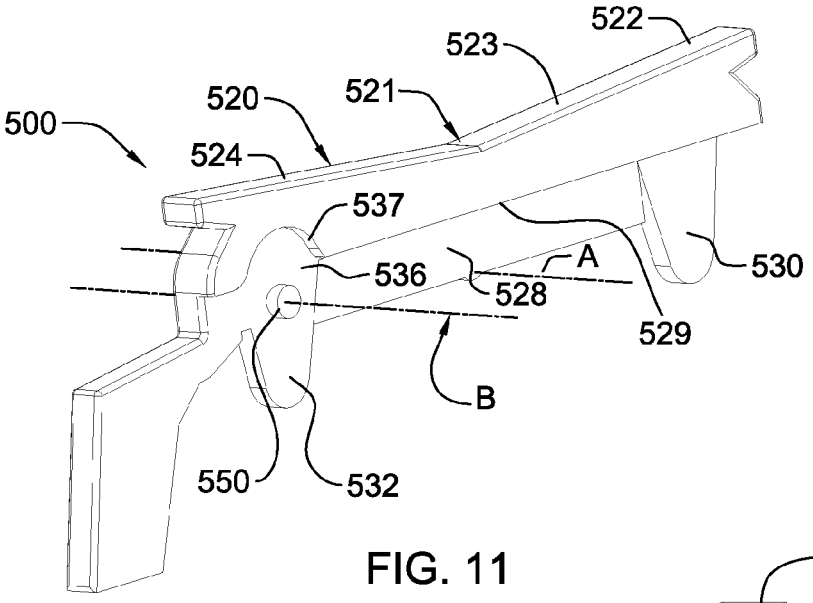
FIG. 11 is a second enlarged perspective view of the dimmer actuator of FIG. 1.
Figure 12:
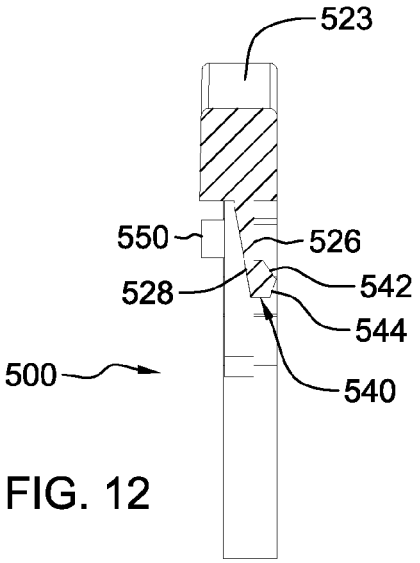
FIG. 12 is an enlarged cross-sectional view of the dimmer actuator taken along line 12-12 in FIG. 10.

As shown in FIGS. 10-12, dimmer actuator 500 may have a generally elongated body 520 having a first end 522, a second end 524, a first side 526, and a second side 528. The dimmer actuator may also include a user engageable top surface 523 between first end 522 and second end 524 for a user to engage. Extending from the bottom of dimmer actuator 500 may be downwardly-depending legs 530 and 532 disposed generally at opposite ends of the elongated body. Legs 530 and 532 may extend through respective openings (not shown) in upper housing 230 (FIGS. 6 and 7) of dimmer module 200.

As described in greater detail below, dimmer actuator 500 is generally movable or pivotable about two axes, e.g., first axis A for use in adjusting the power supplied to the load, and second axis B for use in actuating the air-gap switch. On a first side 526 of dimmer actuator 500, a first post 540 is disposed along axis A; and on second side 528 of dimmer actuator 500, a second post 550 is disposed along axis B. In one embodiment, pivot axis A may be generally disposed below a middle portion 521 of top surface 523 between first end 522 and second end 524. First side 526 and second side 528 of dimmer actuator 500 may be angled relative to each other. For example, in one embodiment, first side 526 may be substantially vertical, and second side 528 may be disposed at an angle. The distal end of first post 540 may include upper and lower chamfered surfaces 542 and 544. The upper portion of the dimmer actuator, which defines top surface 523 for the user to engage for operating the dimmer actuator, may have a greater thickness than the lower portion of dimmer actuator. A recess 536 may be disposed above pivot 550. The upper portion of the recess may be bordered by a curved surface 537.

Figure 13:
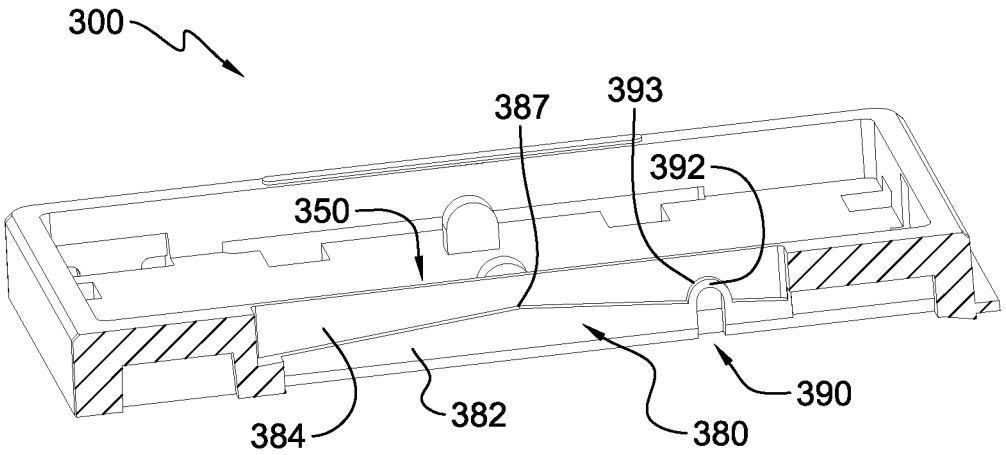
FIG. 13 is a perspective view of the frame, in part cross-section, taken along line 13-13 in FIG. 8.
Figure 14:
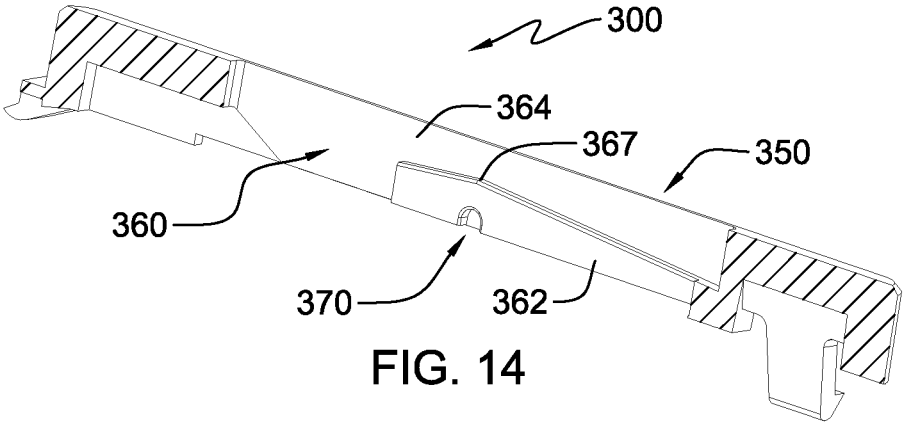
FIG. 14 is a perspective view of the frame, in part cross-section, taken along line 14-14 in FIG. 8.

FIGS. 13 and 14 illustrate one exemplary configuration of opening 350 (also shown in FIG. 8) in frame 300. Opening 350 may be configurable to receive the dimmer actuator. For example, opening 350 may be defined by a first side 360 having a raised portion 362, a recessed portion 364, and a first cutout 370 disposed in raised portion 362. Opening 350 may also be defined by a second side 380 having an raised portion 382, an recessed portion 384, and a second cutout 390. Disposed around cutout 390 is a raised curved portion 392. When dimmer actuator 500 is installed in frame 300, post 550 (FIG. 11) is received in cutout 390 and raised curved portion 392 is received in recess 536 (FIG. 11).

Figure 15:
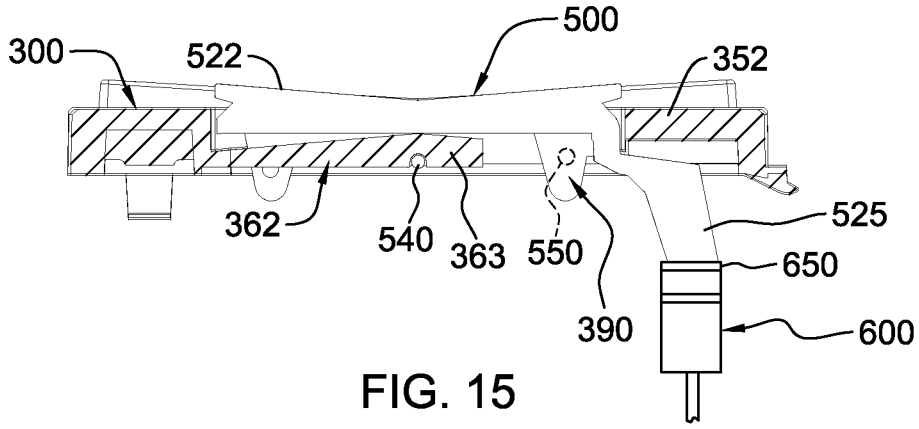
FIG. 15 is an enlarged side view, in part cross-section, of the frame and dimmer actuator, taken along line 15-15 in FIG. 2, illustrating the dimmer actuator disposed in an unbiased position.
Figure 16:
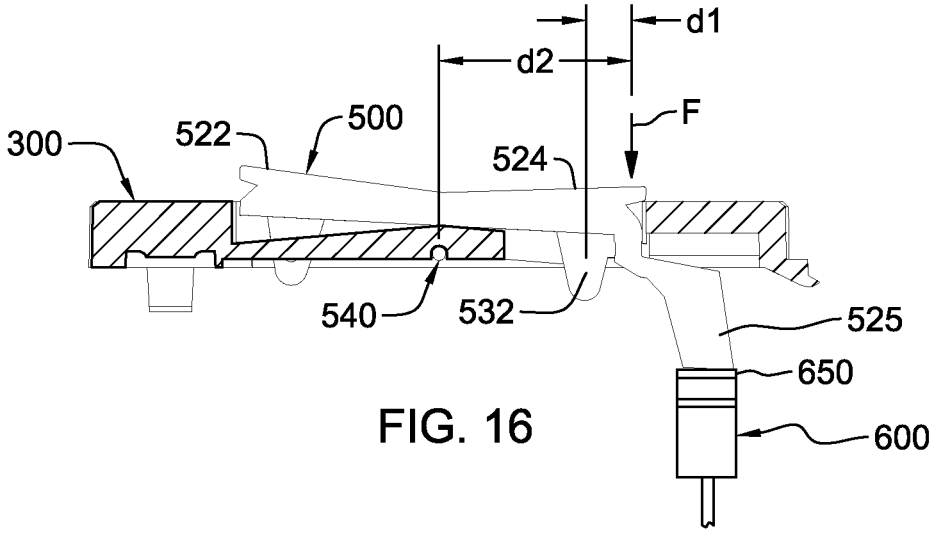
FIG. 16 is an enlarged side view, in part cross-section, of the frame and dimmer actuator, taken along line 16-16 in FIG. 3, illustrating the dimmer actuator disposed in an operable position to adjust the level of the power to the load.
Figure 17:
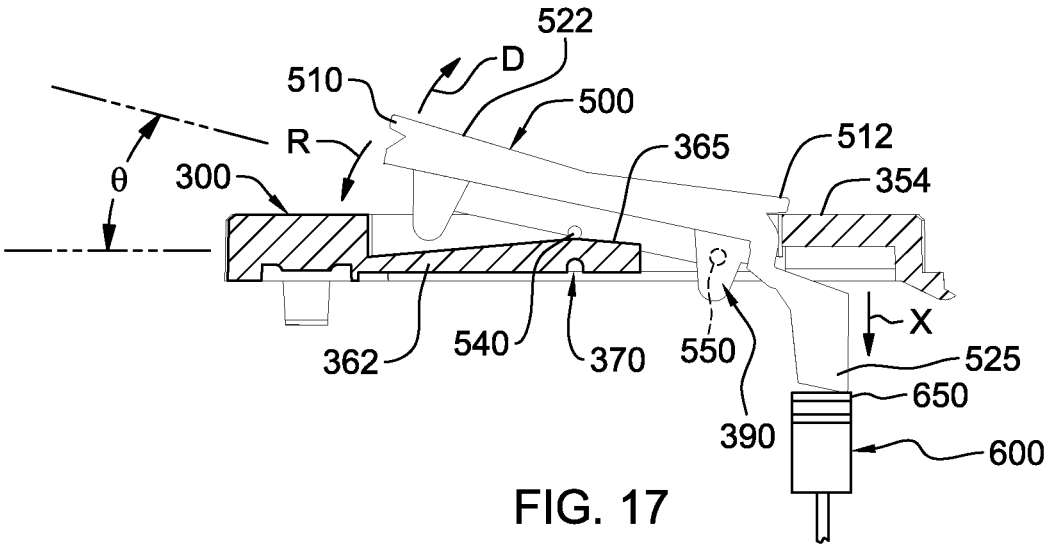
FIG. 17 is an enlarged side view, in part cross-section of the frame and dimmer actuator, taken along line 17-17 in FIG. 4, illustrating the dimmer actuator disposed in a disconnected position to effect an air gap switch.

FIGS. 15-17 illustrate several of the positions of dimmer actuator 500 relative to frame 300. Initially, with reference to FIG. 15, dimmer actuator 500 may be receivable in its respective opening of frame 300. For example, dimmer actuator 500 may be installed in the opening by inserting end 522 through the bottom of frame 300, e.g., between an end 363 of raised portion 362 and an end portion 352 of frame 300, so that second post 550 is received in cutout 390. Thereafter, end 522 of dimmer actuator 500 may be rotated or pushed downwardly so that chamfered edge 544 (FIG. 12) allows first post 540 to engage raised portion 362 and pass between raised portions 362 and 382 of frame 300. For example, portions of frame 300 defining opening 350 (FIGS. 13 and 14) and portions of dimmer actuator 500 may operably flex to allow first post 540 of dimmer actuator 500 to move or slide past raised portion 362 and allow first post 540 to be restrained in or otherwise generally latched in cutout 370 (FIG. 14), and second post 550 disposed in second cutout 390 such as shown in FIG. 15.

Figure 18:
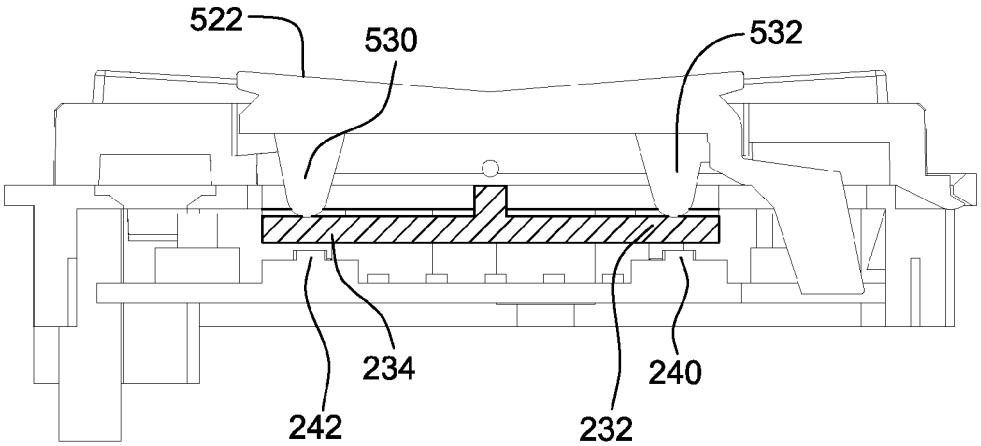
FIG. 18 is an enlarged side view, in part cross-section, of the switch plate assembly and a portion of the dimmer module of FIG. 1.

Dimmer actuator 500 may toggle between two brightness controlling positions. For example, in a first brightness controlling position, such as shown in FIG. 16, upper end 524 may be pressed toward frame 300 so that dimmer actuator leg 532 extends away from frame 300, e.g., away from the bottom edge of the frame. With reference to FIG. 18, leg 532 may engage a leaf spring 232 operable to actuate a first switch 240 for increasing the power to the load; e.g., first switch 240 and leaf spring 232 may be a snap-action switch disposed within the upper housing 230. As will be appreciated, a force F applied to upper end 524 of dimmer actuator 500 by a user in dimming the dimmer switch acts to generally cause a rotation generally about pivot 540 and not a rotation about pivot 550 (FIG. 15). For example, a torque, moment or moment of force is the tendency of a force to rotate an object about an axis, fulcrum, or pivot, and is generally defined as the product of the distance of a force from an axis times the magnitude of the force, i.e., F×d, where F is the magnitude of the force and d is the moment of the force. Thus, the torque applied generally about pivot 540 (e.g., the product of F×d2 in FIG. 16) is greater than the torque applied about pivot 550 (e.g., the product of F×d1), so that in normal operation of dimmer actuator, a user controls the dimming of the dimmer switch and is inhibited from actuating air gap switch 600.

Similarly, in a second brightness controlling position, by pressing end 522 downwardly, dimmer actuator leg 530 may engage a leaf spring 234, wherein the leaf spring actuates a second switch 242 for decreasing the power to the load; e.g., second switch 242 and leaf spring 234 may be a snap-action switch disposed within the upper housing 230. A second/bottom housing 270 (FIGS. 6 and 7) of the dimmer module may support a printed circuit board (PCB) which holds circuitry for performing dimmer functions such as switching a light on or off and adjusting power to a light. The PCB may support a power switch (not shown) and the air-gap switch. It should be noted that the dimmer may be assembled in any of a number of suitable manners not limited to the structure described herein.

With reference again to FIGS. 15 and 16, frame 300 and dimmer actuator 500 have cooperating bearing surfaces for rocking/pivoting/toggling dimmer actuator 500 between the two brightness controlling positions. For example, frame 300 may include upper edge portions 367 (FIG. 14) and 387 (FIG. 13) of raised portions 362 (FIG. 14) and 382 (FIG. 13), respectively, of frame 300 acting as a fulcrum/pivot point or bearing surface for supporting rotation of center bottom portions or bearing surface 527 (FIG. 10) and 529 (FIG. 11) of dimmer actuator 500. Thus, in some embodiments, the configuration of raised portions 362 (FIG. 14) and 382 (FIG. 13) and the configuration of dimmer actuator 500 may act in concert or interact in combination with post 540 and cutout 370 (FIG. 14).

Figure 19:
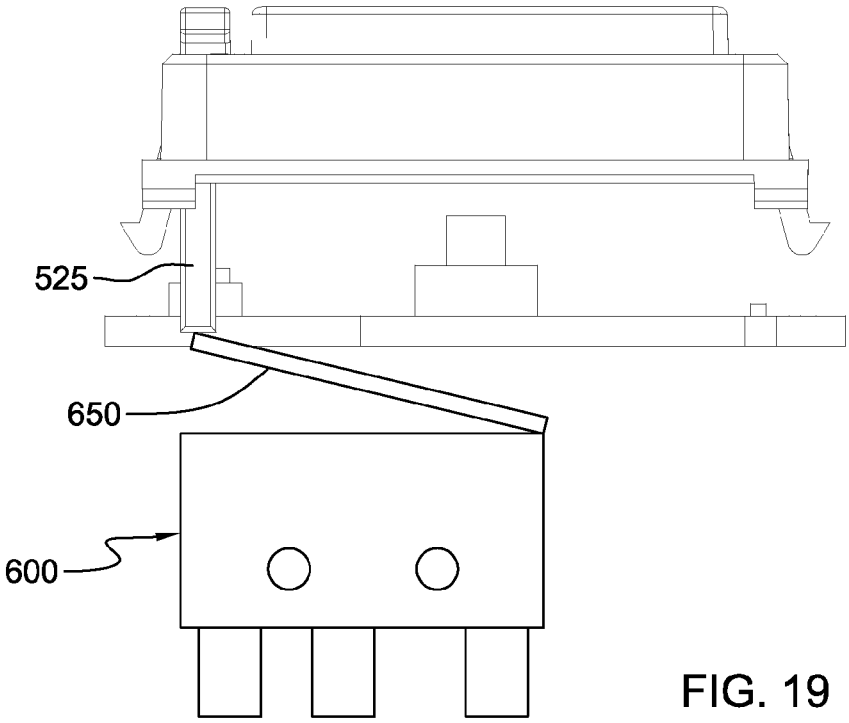
FIG. 19 is an enlarged top view of the switch plate assembly and a portion of the dimmer module of FIG. 1.

With reference to FIG. 17, the dimmer switch may be placed in its disconnected position in which the air-gap switch, referred to as a "hard switch off", allows a user to, for instance, change or replace a light source without risk of an electrical shock. For example, dimmer switch may be placed in its disconnected position by moving lifting lip 510 of dimmer actuator 500 in the direction of arrow D away from frame 300 so that first post 540 disengages and/or slides out from first cutout 370, and dimmer actuator pivots about second post 550 disposed in second cutout 390. In the disconnected position, a downwardly-depending distal end portion 525 of dimmer actuator 500 engages an air-gap switch 600 placing the air-gap switch in its disconnected position thereby disconnecting power to the load and dimmer. With post 540 resting on an upper surface 365 of raised portion 362, dimmer actuator 500 remains in the disconnected position until it is moved back to its operational position. Rotation of dimmer actuator 500 about second post 550 in the direction of arrow D may be restrained or stopped from rotation and which may limit further rotation of the dimmer actuator by a bottom surface of a lip 512 of dimmer actuator 500 engaging a surface 354 of frame 300 adjacent opening 350 (FIG. 8). In the disconnected position, dimmer actuator 500 may be rotated about second pivot 550 to an angle θ of about 5 degrees to about 15 degrees; e.g., rotated to about 10 degrees. In the disconnected position, as shown in FIGS. 17 and 19, distal end portion 525 of dimmer actuator 500 moves in the direction shown by arrow X to engage a lever 650 of air-gap switch 600 to place the air-gap switch in its disconnected position, thereby disconnecting power.

In addition, placing dimmer switch in its disconnected position by moving lifting lip 510 of dimmer actuator 500 in the direction of arrow D away from frame 300 may include frame 300 and dimmer actuator 500 having cooperating bearing surfaces. For example, upper edge portion 393 (FIG. 13) of raised curved portion 392 (FIG. 13) of frame 300 may act as a fulcrum/pivot for supporting rotation of curved surface 537 (FIG. 11) of dimmer actuator 500. Thus, in some embodiments, the configuration of raised curved portion 392 (FIG. 13) and the configuration of dimmer actuator 500 may act in concert or interact in combination with post 550 and cutout 330 (FIG. 13).

With reference again to FIGS. 15 and 16, air-gap actuator 600 may be pre-engaged such that air-gap switch lever 650 makes contact with distal end portion 525 of dimmer actuator 500 but does not press on lever 650 sufficiently to actuate air-gap switch 650. Thus, when the dimmer actuator is in the operational position shown in FIG. 15, the air-gap switch is in its ON position, thereby allowing a user to operate dimmer 10.

Thus, the present disclosure provides a dimmer with an air-gap switch that is actuated by the dimmer actuator. This configuration permits the air-gap switch to be located behind the switch plate assembly such that it is not visible to a user, allowing for improved appearance of the dimmer switch. Upon rotation of the dimmer actuator to its disconnected position as shown in FIG. 17, second post 550 rotates about a cylindrical surface 592 (FIG. 13) of cutout 390 in frame 500. The first post of the dimmer actuator sliding out of the first cutout, and the second post being restrained in the second cutout results in distal end portion 525 being moved, rotated and/or angled downwardly to actuate the air gap switch.

After using the dimmer actuator to physically disconnect the dimmer switch from the load (as shown in FIG. 17), a user may restore the dimmer switch to its operational position (FIGS. 1 and 15). For example, a user may move the bottom portion of dimmer actuator 500 in the direction of arrow R to allow first post 540 to slide into first cutout 370 and be received in first cutout 370 of frame 300. Distal end portion 525 is thus moved away from air-gap switch 600, releasing pressure on lever 650 so that the air-gap switch returns to its ON position, thereby allowing a user to operate dimmer switch 10.

From the present description, it will be appreciated that the pivots points or axes of the dimmer actuator may be placed in other spaced-apart locations. For example, while the second pivot is disposed in alignment with the downwardly depending leg, it will be appreciated that the second pivot may be disposed away from the second leg.

The air-gap switch, controlled by the dimmer actuator and described in greater detail below, may be a multi-terminal normally closed (NC) switch which makes a conductive path across its terminals when it is in its ON (closed) position and breaks the conductive path when it is in its disconnected (open) position. The air-gap switch is coupled in series with the power switch so that when the air-gap switch is in its ON position, the power switch and the dimmer actuator are enabled allowing a user to operate the dimmer. On the other hand, when the air-gap switch is in its disconnected position, electrical power is physically disconnected from the load so that the power switch and the dimmer actuator are disabled preventing a user from powering the load.

In a typical application, an electrical wiring system of a home may include dimmer switch 10 electrically coupled between an alternating current (AC) power source, such as a 120 Volts, 60 Hz power, and a load. For example, the dimmer switch can be connected to a light to control the brightness of the light or connected to a fan to control the speed of the fan. In the operational position, the dimmer actuator disengages the air-gap switch by placing the air-gap switch in its ON position allowing a user to operate the electrical load (e.g., light or fan).

With reference again to FIG. 1, the dimmer switch may be operable/programmed for controlling a light in many different operating configurations as follows. For example, by pressing on the upper half of main actuator 400, the lights will brighten to the last set light level. By pressing the lower half of main actuator 400, the lights will turn OFF. The previous light level may remain in memory upon the next ON operation. By tapping on the upper half of dimmer actuator 500 when the light is off, the lights could brighten to the last set light level. By pressing and holding the lower half of the dimmer actuator for a predetermined amount of time, or by tapping the lower half twice quickly, the lights could dim to OFF. When the light is on, pressing and holding, or tapping, the upper half of the dimmer actuator could brighten the lights to the desired light level. Tapping on the upper half of the dimmer actuator twice quickly while the light is on may be operable to turn on the lights to full bright brightness. It will be appreciated that the dimmer switch may be programmed/operable to have other operating configurations than those described.

Figure 20:
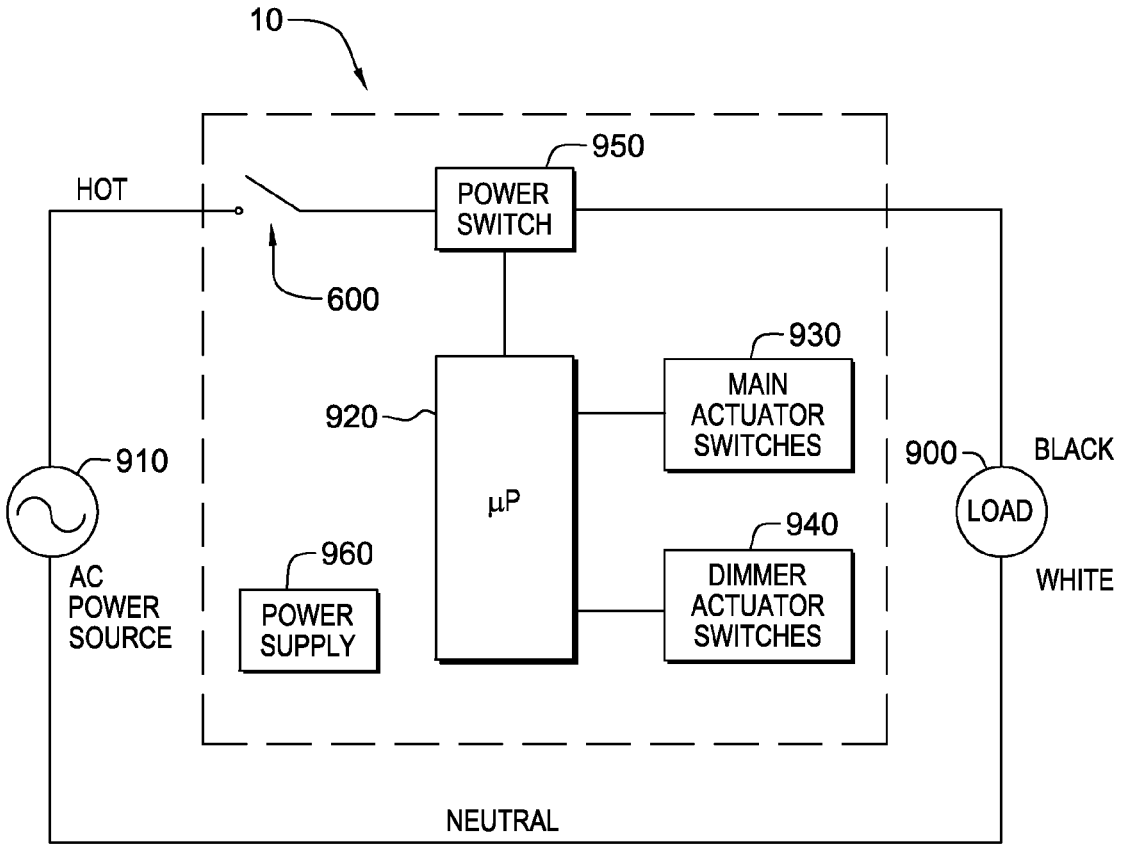
FIG. 20 is one embodiment of a circuit diagram of the dimmer switch of FIG. 1.

FIG. 20 is a diagram illustrating an embodiment of dimmer switch 10 connected to a load 900, such as but not limited to a light or a fan, connected between the hot and neutral terminals of a standard source 910 of electrical energy. In this illustrated embodiment, dimmer switch 10 may include a controller 920 such as but not limited to a microprocessor/microcontroller coupled to user accessible actuators, such as one or more main actuator switches 930, and one or more dimmer actuator switches 940, such as switches 240 and 242 (FIG. 18), and a power switch 950, such as but not limited to a solid state switching device, connected in series with air gap switch 600, wherein the air gap switch is operable to stop current flow to the load. The electrical energy can be controlled by switch 950 to switch on load 900, increase or decrease the intensity of load 900, or switch off electrical load 900. A power supply 960 operably provides power to the circuitry of the device such as to controller 920.

For example, the dimmer switch may selectively provide a varying portion of the electrical energy available at the input to the load. Such a device, for example, may supply a fraction of the input voltage to the load with the fraction being selected by the user. For example, switch 950 such as, but not limited to, a solid state switching device or controllably conductive device may be a thyristor, a TRIAC, a SCR, a MOSFET, etc. Switch 950 may be controlled by controller 920 to provide adjustable power to the load, e.g., control the on/off state and the brightness level such as to a light.

The electrical energy flowing through load 900 can be a 120/220 volt AC (alternating current), 60/50 Hz signal. The AC signal (current and/or voltage) may be a sinusoidal voltage signal symmetrically alternating about a zero volt reference point. In one embodiment, the power switch may be controlled by the controller to limit the output voltage to a fraction of that of a full sine wave. Other suitable dimming mechanisms can be used without departing from the spirit of the disclosure.

With reference still to FIG. 20, in one embodiment, a controller may provide a gating signal to the gate of a TRIAC to turn it on and control the brightness level by controlling when in each half cycle it provides that gating signal to perform phase dimming. For example, controller 920 may control the amount of current flowing through load 900 by applying a certain signal to the gate of switch 950 where provided by a TRIAC through a control line. For example, controller 920 may cause bursts of an input line voltage to go through switch 950 where provided by a TRIAC by turning ON and turning OFF switch 950 at a desired rate. Dimmer switch 10 can be configured so that activation of one of dimmer actuator switches 940, e.g., via pressing an upper portion of dimmer actuator 500 (FIG. 1), can increase the brightness level by increasing the duration the power switch conducts in the respective sine wave, whereas activation of the other of the dimmer actuator switches 940, e.g., via pressing a lower portion of dimmer actuator 500 (FIG. 1), can decrease the brightness level by decreasing the duration the power switch conducts in the respective sine wave.

The switch ON time period may be equal to, less than, or more than the switch OFF time period. The amount of current flowing through load 900 can depend on the duty cycle (ratio of switch ON time period to switch OFF time period) of the controller generated signal applied to the gate of switch 950 where provided by a TRIAC and, thus, the intensity of load 900, such as the intensity of light emitted if load 900 comprises a lighting element, also will depend on this signal.

As described above, controller 920 may provide such gating signals to the gate of switch 950 where provided by a TRIAC through a control line to turn it on and control the amount of current flowing through load 900. In addition, dimmer switch 10 can also be configured so that activation of one of main actuator switches 930, e.g., via pressing an upper portion of main actuator 400 (FIG. 1), allows such bursts of the input line voltage to go through switch 950 turning ON and OFF switch 950 at a desired rate to turn on electrical load 900 such as to the last brightness setting that controller 920 had before it was turned off, whereas activation of the other of the main actuator switches 930, e.g., via pressing a lower portion of main actuator 400 (FIG. 1), can terminate such bursts of the input line voltage to switch 950 to turn off electrical load 900. As explained in greater detail above, dimmer actuator 500 (FIG. 1) may also be operable to actuate air-gap switch 600 for physically disconnecting power to the load.

In some embodiments, the frame may also include an opening for a power indicator (e.g., an LED) to indicate the status of the power switch. For an embodiment in which a power indicator is an LED, the LED may be configured to be ON when the dimmer is switched OFF allowing a user to locate the dimmer in a dark room. When the dimmer is switched ON, the LED may be configured to be OFF. Alternatively, the LED may be configured to be ON at a certain brightness when the dimmer is switched OFF and at a different brightness when the dimmer is switched OFF; e.g., LED is at a lower brightness when the dimmer is switched off and at a higher brightness when the dimmer is switched ON, or vice versa. Similarly, the brightness of the LED could be dependent upon a detected brightness level, e.g., as determined by a photocell (not shown).

In other embodiments, the dimming module may include two actuators, e.g., a main actuator and a dimmer actuator. Each actuator may interact with some interface element of the device in order to indicate to the device's controller that the actuator has undergone some operation. The main actuator, at least in one embodiment, interacts with two tactile switches, one is actuated when the top portion of the main actuator is depressed and the other is actuated when the bottom portion of the main actuator is depressed; these actuations are registered by the controller (typically, up for ON and down for OFF). Two tactile switches are not necessarily needed and the main actuator can be configured to simply "toggle" a single tactile switch with the controller interpreting the toggles accordingly. The dimmer actuator, in one preferred embodiment, interacts with two tactile switches in similar fashion to the main actuator but actuation of the dimmer actuator by a user is registered/interpreted by the controller as "increase"

and "decrease", typically up for increase and down for decrease (bright and dim). Additionally, in accordance with the present disclosure, the dimmer actuator also interacts with a separate switch which functions to physically break the connection between the AC power supply provided by the premise's wiring and the electrical load; e.g., air gap switch, or a snap-action switch such as a MICRO SWITCH. Other than the air-gap switch, which is a physical make-break switch, actuations of the tactile switches for ON/OFF and dim/bright may be inputs that are provided to a controller which interprets such inputs and acts accordingly to control, either directly or indirectly through intermediary circuitry, a controllably conductive switch (e.g., a TRIAC, SCR, MOSFET, etc.; preferably the controllably conductive switch is bi-directional) by providing a control signal to the controllably conductive switch to render it conductive for some portion of each AC half-cycle in accordance with the brightness level set by the dimmer actuator.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of ordinary skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples to describe the disclosure, and also to enable any person skilled in the art to practice the present disclosure, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. An electrical dimmer switch comprising:

an air-gap switch for coupling to a power source;

a power semiconductor switch connected in series with said air-gap switch, said power semiconductor switch electronically controlling power to a load;

a dimmer module, connected to said power semiconductor switch, for coupling to the load to deliver an adjustable level of power to the load; and a dimmer actuator movable between an operational position and a disconnected position wherein said dimmer actuator is configured to act as a single control mechanism for selectively engaging either said dimmer module to adjust the level of power delivered to the load when in said operational position or said air-gap switch when in said disconnected position.

2. The electrical dimmer switch of claim 1 wherein said dimmer actuator being rotatable about a first pivot axis when in said operational position, and said dimmer actuator rotatable about a second pivot axis spaced apart from said first pivot axis when in said disconnected position.

3. The electrical dimmer switch of claim 2 wherein said second pivot axis is disposed generally adjacent to an end portion of a user engageable surface of said dimmer actuator.

4. The electrical dimmer switch of claim 2 wherein said first pivot axis is disposed generally adjacent to a middle portion of a user engageable surface of said dimmer actuator for use in adjusting the level of power delivered to the load, and said second pivot axis is disposed generally adjacent to an end portion of said user engageable surface of said dimmer actuator.

5. The electrical dimmer switch of claim 1 wherein said dimmer actuator comprises a downwardly-depending distal end portion, and said air-gap switch comprises a lever engageable by said downwardly-depending distal end portion of said dimmer actuator.

6. The electrical dimmer switch of claim 1 wherein said dimmer actuator comprises a lip for use in moving said dimmer actuator from said operational position to said disconnected position.

7. The electrical dimmer switch of claim 1 wherein said air-gap switch is a normally-closed switch, so that said air-gap switch is closed in accordance with said dimmer actuator being in said operational position.

8. The electrical dimmer switch of claim 1 wherein said power semiconductor switch comprises a thyristor, a TRIAC, a silicon-controlled rectifier, or a MOSFET.

9. An electrical dimmer switch comprising:

an air-gap switch for coupling to a power source;

a power semiconductor switch connected in series with said air-gap switch, said power semiconductor switch electronically controlling power to a load;

a dimmer module, connected to said power semiconductor switch, for coupling to the load to deliver an adjustable level of power to the load;

a dimmer actuator movable between an operational position and a disconnected position wherein said dimmer actuator is configured to act as a single control mechanism for selectively engaging either said dimmer module to adjust the level of power delivered to the load when in said operational position or said air-gap switch when in said disconnected position; and said dimmer actuator comprises an elongated member having a first elongated side comprising a first outwardly extending post having a first axis, and an opposite second elongated side comprising a second outwardly extending post having a second axis offset from said first outwardly extending post, and said dimmer actuator being generally pivotable about said first post when in said operational position, and generally pivotable about said second post when in said disconnected position.

10. The electrical dimmer switch of claim 9 wherein said first post is disposed generally adjacent to a middle portion of a user engageable surface of said dimmer actuator for use in adjusting the level of power delivered to the load, and said second post is disposed generally adjacent to an end portion of said user engageable surface of said dimmer actuator.

11. The electrical dimmer switch of claim 9 wherein at least portions of said first elongated side and said second elongated side define a generally longitudinally-extending tapered cross-section.

12. The electrical dimmer switch of claim 9 wherein said dimmer actuator comprises a downwardly-depending distal end portion, and said air-gap switch comprises a lever engageable by said downwardly-depending distal end portion of said dimmer actuator.

13. The electrical dimmer switch of claim 9 wherein a distal end of said first post comprises chamfered surfaces.

14. An electrical dimmer switch comprising:

an air-gap switch for coupling to a power source;

a power semiconductor switch connected in series with said air-gap switch, said power semiconductor switch electronically controlling power to a load;

a dimmer module, connected to said power semiconductor switch, for coupling to the load to deliver an adjustable level of power to the load;

a dimmer actuator movable between an operational position and a disconnected position wherein said dimmer actuator is configured to act as a single control mechanism for selectively engaging either said dimmer module to adjust the level of power delivered to the load when in said operational position or said air-gap switch when in said disconnected position;

a main actuator; and a frame having a central opening for accommodating the main actuator operable for use in turning on and off the power to the load, and a second opening for receiving said dimmer actuator, said dimmer actuator being connected about a first pivot axis relative to said frame when in said operational position, and connected about a second pivot axis relative to said frame different from said first pivot axis when in said disconnected position.

15. The electrical dimmer switch of claim 14 wherein said dimmer actuator comprises an elongated member having a first elongated side comprising a first outwardly extending post, and an opposite second elongated side comprising a second outwardly extending post offset from said first outwardly extending post, and said first post pivotable about said first pivot axis, and said second post pivotable about said second pivot axis.

16. The electrical dimmer switch of claim 15 wherein said frame comprises a first cutout for receiving said first post and a second cutout for receiving said second post.

17. The electrical dimmer switch of claim 16 wherein said first cutout comprises a first partial cylindrical surface defining a first bearing surface for pivotally supporting said first post, and wherein said second cutout comprises a second partial cylindrical surface defining a second bearing surface for pivotally supporting said second post.

18. The electrical dimmer switch of claim 16 wherein said first post being disconnectable from said first cutout in said frame when said dimmer actuator is disposed in said disconnected position.

19. The electrical dimmer switch of claim 18 wherein a distal end of said first post comprises chamfered surfaces for aiding disconnection of said first post from said first cutout, and for insertion of said first post into said first cutout.

20. The electrical dimmer switch of claim 14 wherein said frame and said dimmer actuator comprises cooperating bearing surfaces engageable during movement of said dimmer actuator in said operational position.

21. The electrical dimmer switch of claim 14 wherein said frame and said dimmer actuator comprises cooperating bearing surfaces engageable during movement of said dimmer actuator in said disconnected position.

22. The electrical dimmer switch of claim 14 wherein said dimmer actuator comprises a downwardly-depending distal end portion, and said air-gap switch comprises a lever engageable by said downwardly-depending distal end portion of said dimmer actuator.

23. The electrical dimmer switch of claim 14 wherein said main actuator, said dimmer actuator, and said frame form an assembly detachably coupled to said dimmer module.

* * * * *